US006058583A

United States Patent [19]

Takeuchi et al.

[11] Patent Number: 6,058,583

[45] Date of Patent: May 9, 2000

[54] WET PROCESS FOR MANUFACTURING NONWOVEN FABRIC AND APPARATUS THEREFOR

[75] Inventors: Naohito Takeuchi; Kazuya Okada; Takayoshi Konishi, all of Kagawa, Japan

[73] Assignee: Uni-Charm Corporation, Kawonoe, Japan

[21] Appl. No.: 09/356,774

[22] Filed: Jul. 16, 1999

[30] Foreign Application Priority Data

Jul. 17, 1998 [JP] Japan ..... 10-203206

[51] Int. Cl.[7] ..... D04H 1/46

[52] U.S. Cl. ..... 28/104; 28/167

[58] Field of Search ..... 28/104, 105, 167, 28/103; 162/115, 123, 129, 130, 131, 204; 68/204, 205 R, 200; 19/66 R, 296, 304, 308

[56] References Cited

U.S. PATENT DOCUMENTS

| | | | |
|---|---|---|---|
| 728,804 | 5/1903 | Lindberg | 28/104 |
| 1,453,575 | 5/1923 | Tong et al. | 28/104 |
| 3,676,245 | 7/1972 | Helmut et al. | 28/105 |
| 5,290,628 | 3/1994 | Lim et al. | 28/104 |
| 5,301,401 | 4/1994 | Suzuki et al. | 28/167 |
| 5,389,202 | 2/1995 | Everhart et al. | 162/115 |
| 5,429,912 | 7/1995 | Oathout | 28/105 |
| 5,593,533 | 1/1997 | Groshens | 28/105 |
| 5,761,778 | 6/1998 | Fleissner | 28/104 |
| 5,888,346 | 3/1999 | Radwanski et al. | 28/104 |

*Primary Examiner*—Amy B. Vanatta
*Attorney, Agent, or Firm*—Darby & Darby

[57] ABSTRACT

This invention provides a wet process for manufacturing a nonwoven fabric, including the steps of: forming a fibrous web by supplying raw material fibers together with water onto a slope of a net-shaped wire conveyor band running on a plurality of rolls; completely forming a nonwoven fabric over the wire conveyor band by supplying water jets to the fibrous web over the wire conveyor band; transferring the formed nonwoven fabric from the wire conveyor band to another conveyor band; and drying the nonwoven fabric. Also disclosed is an apparatus using the wet nonwoven fabric manufacturing process.

17 Claims, 6 Drawing Sheets

WET PROCESS FOR MANUFACTURING NONWOVEN FABRIC AND APPARATUS THEREFOR

FIELD OF THE INVENTION

The present invention relates to a wet process and an apparatus for manufacturing a spun lace nonwoven fabric (or fiber-interlaced nonwoven fabric) and, more particularly, to a wet, nonwoven fabric manufacturing process and apparatus for the formation of a fibrous web and treatment with water jets by using improved conventional wet paper making facilities.

BACKGROUND OF THE INVENTION

In a dry process for manufacturing a spun lace nonwoven fabric (or fiber-interlaced nonwoven fabric), a fibrous web is formed by one or more stages of carding machines and is conveyed to a fiber interlacing step. At this fiber interlacing step, the fibrous web is conveyed by a wire conveyor band of a predetermined mesh so that water jets are applied to the fibrous web to interlace the fibers thereby forming a nonwoven fabric. This nonwoven fabric thus formed at the fiber interlacing step is further conveyed to and dried at a drying step.

In a wet process for manufacturing a spun lace nonwoven fabric of the prior art, on the other hand, at the wet forming step, raw material fibers are supplied together with water onto a net-shaped wire conveyor band of a predetermined mesh to form a fibrous web. A felt conveyor band is then contacted by the wire conveyor band so that the fibrous web over the wire conveyor band is transferred to the felt conveyor band due to the difference in the surface roughness between the wire and felt conveyor bands. By this felt conveyor band, the fibrous web is conveyed to a fiber interlacing step.

At the fiber interlacing step, there is provided a wire conveyor band running on a plurality of rolls, and the fibrous web is transferred from the felt conveyor band to the wire conveyor band. Water jets are then applied to the fibrous web being conveyed over the wire conveyor band, so that the fibers of the fibrous web are interlaced to form the nonwoven fabric. This nonwoven fabric is conveyed from the fiber interlacing step to the drying step where it is dried.

The dry process for manufacturing the spun lace nonwoven fabric cannot increase the treating rate more than the fiber supplying rate at the carding machine. As a result, the speed of manufacturing the nonwoven fabric as a whole is lowered and limited at about 100 m per minute at most, so that the dry process is inferior in productivity. On the other hand, the dry process cannot manufacture a soft, nonwoven fabric because the fibers which are treated by the carding machine become relatively thick (about 1.5 to 3 deniers).

In this respect, the wet spun lace nonwoven fabric manufacturing process (wet process) can form nonwoven fabric having fibers as thin as about 0.1 to 0.5 deniers so that it can manufacture a nonwoven fabric having softness such as for use on glass plates or lenses, or as wet tissues.

In the wet spun lace nonwoven fabric manufacturing processes of the prior art, however, the fibrous web is formed by the wet forming machine and conveyed by the felt conveyor band to the fiber interlacing step, at which water jets are applied. As a result, this complicates the facilities and creates a longer manufacturing line, thereby requiring a larger space for installing the facilities.

SUMMARY OF THE INVENTION

In order to solve the aforementioned problems of the prior art, an object of the invention is to provide a wet process and apparatus for manufacturing a nonwoven fabric, which shorten a manufacturing line by applying water jets to the fibrous web just after being formed.

Another object of the invention is to provide a wet nonwoven fabric manufacturing process and apparatus for manufacturing a spun lace nonwoven fabric at a high speed by making more effective use of the facilities for the wet paper making process of the prior art.

In a first embodiment of the invention, there is provided a wet process for manufacturing a nonwoven fabric, comprising the steps of: forming a fibrous web by supplying raw material fibers together with water onto a slope of a net-shaped wire conveyor band running on a plurality of rolls; completely forming a nonwoven fabric over the wire conveyor band by supplying water jets to the fibrous web over the wire conveyor band; transferring the formed nonwoven fabric from the wire conveyor band to another conveyor band; and drying the nonwoven fabric.

In this embodiment, the fibrous web is formed over the wire conveyor band by the slope wire method, and the water jets are instantly applied to the used wire conveyor band so that the formation of the nonwoven fabric is completed over the wire conveyor band. This makes it possible to shorten the line remarkably.

In a second embodiment of the invention, there is further provided a wet process for manufacturing a nonwoven fabric, comprising the steps of: forming a fibrous web by supplying raw material fibers together with water onto a net-shaped wire conveyor band running on a cylinder mold to scoop the raw material fibers with the wire conveyor band; completely forming a nonwoven fabric over the wire conveyor band by supplying water jets to the fibrous web over the wire conveyor band; transferring the formed nonwoven fabric from the wire conveyor band to another conveyor band; and drying the nonwoven fabric.

This embodiment can make effective use of the uni-flow (or counter-flow) type cylinder Yankee machine as the wet paper making facilities of the prior art. In the conventional uni-flow type cylinder Yankee machine, the fibrous web scooped with the cylinder mold is transferred to and conveyed on a felt (or blanket) conveyor band. In the process (and apparatus) of this embodiment, the water jets can be instantly applied to the fibrous web just scooped, by providing the wire conveyor band to run on the cylinder mold, in place of the felt conveyor band of the conventional uni-flow type cylinder Yankee machine, and by scooping the raw material fibers onto the wire conveyor band. Thus, the spun lace nonwoven fabric can be manufactured by slightly improving the conventional uni-flow type cylinder Yankee machine.

In a third embodiment of the invention, there is still further provided a wet process for manufacturing a nonwoven fabric, comprising the steps of: forming a fibrous web by supplying raw material fibers together with water onto a net-shaped wire conveyor band running on a cylinder mold to scoop the raw material fibers with the wire conveyor band; transferring the fibrous web over the wire conveyor band to a wire conveyor band at a next stage; completely forming a nonwoven fabric over the wire conveyor band at the next stage by supplying water jets to the fibrous web over the wire conveyor band; transferring the formed nonwoven fabric from the wire conveyor band to another conveyor band; and drying the nonwoven fabric.

In this third embodiment, the fibrous web over the wire conveyor band running on the cylinder mold is preferably forcibly transferred to the wire conveyor band at the next stage by using a pneumatic pressure. In this method, the fibrous web is transferred by injecting air jets by the pneumatic pressure from the wire conveyor band on the cylinder mold side to the next stage wire conveyor band. Alternatively, the fibrous web may be transferred by using a pneumatic suction on the side of the next stage wire conveyor band.

This embodiment can make effective use of the former type cylinder Yankee machine as the wet paper making facilities of the prior art. In the conventional former type cylinder Yankee machine, the fibrous web scooped with the cylinder mold is transferred to and conveyed on a felt (or blanket) conveyor band at the next stage. In the process (and apparatus) of this embodiment, the wire conveyor band is provided to run on the cylinder mold, and the next stage wire conveyor band is provided in place of the felt conveyor band of the conventional former type cylinder Yankee machine, so that the water jets can be instantly applied to the fibrous web. Thus, the spun lace nonwoven fabric can be manufactured by slightly improving the conventional former type cylinder Yankee machine.

The invention is not limited to the case in which the fibrous web over the wire conveyor band is interlaced completely or over a wide range to form the nonwoven fabric by applying the water jets to the wire conveyor band, and includes the case in which the energy of the water jets is adjusted to interlace the fibrous web partially or slightly to manufacture a bulky and water-dispersible nonwoven fabric which can be dispersed with much water at the time of disposal.

In the invention, the nonwoven fabric completely formed over the wire conveyor band is preferably forcibly transferred to another conveyor band by using a pneumatic suction, for example, using a suction pickup roll provided on the side of another conveyor band. Alternatively, the nonwoven fabric may be forcibly transferred by using a pneumatic pressure established by the air injection from the side of the wire conveyor band.

Further, the water jets can be applied to the surface and back sides of the fibrous web over the wire conveyor band.

The invention also provides wet apparatuses for manufacturing a nonwoven fabric.

In a first embodiment of an apparatus of the invention, a wet apparatus is provided for manufacturing a nonwoven fabric, comprising: a net-shaped wire conveyor band for running on a plurality of rolls; a raw material supply portion for supplying raw material fibers together with water onto a slope of the wire conveyor band; water jet nozzles confronting the wire conveyor band for forming a nonwoven fabric completely over the wire conveyor band by applying water jets to a fibrous web formed over the wire conveyor band; another conveyor band to which the nonwoven fabric completely formed over the wire conveyor band is transferred; and a drying portion at a downstream stage for drying the nonwoven fabric.

In a second embodiment of an apparatus of the invention, there is provided a wet apparatus for manufacturing a nonwoven fabric, comprising: a raw material bath to which raw material fibers are supplied together with water; a cylinder mold disposed in the raw material bath; a net-shaped wire conveyor band made to run on the cylinder mold; water jet nozzles confronting the wire conveyor band for forming a nonwoven fabric completely by applying water jets to a fibrous web scooped over the wire conveyor band from the inside of the raw material bath; another conveyor band to which the nonwoven fabric completely formed over the wire conveyor band is transferred; and a drying portion at a downstream stage for drying the nonwoven fabric.

In a third embodiment of the invention, there is provided a wet apparatus for manufacturing a nonwoven fabric, comprising: a cylinder mold; a net-shaped wire conveyor band made to run on the cylinder mold; a former for forming a fibrous web over the wire conveyor band by applying raw material fibers and water to the wire conveyor band; a next stage wire conveyor band to which the fibrous web formed over the wire conveyor band is transferred; water jet nozzles confronting the next stage wire conveyor band for forming a nonwoven fabric completely by applying water jets to the fibrous web over the next stage wire conveyor band; another conveyor band to which the nonwoven fabric completely formed over the wire conveyor band is transferred; and a drying portion at a downstream stage for drying the nonwoven fabric.

In the third embodiment, the wet nonwoven fabric manufacturing apparatus preferably comprises a transfer means for transferring the fibrous web forcibly from the wire conveyor band running on the cylinder mold to the next stage wire conveyor band by using a pneumatic pressure. Alternatively, this transfer means using a pneumatic pressure may be replaced with transfer means using a pneumatic suction. This transfer means prevents the bulkiness or the soft feeling of the fiber web from deteriorating.

In each of the foregoing individual apparatuses, because the nonwoven fabric is formed over the wire conveyor band by applying the water jets and the fibers are entangled with the wire to some extent, it is relatively difficult to transfer the nonwoven fabric formed over the wire conveyor band to another conveyor band. Therefore, it is preferred that the nonwoven fabric formed over the wire conveyor band is transferred to another conveyor band by a transfer means using a pneumatic suction, without holding and pressing the nonwoven fabric between a roll of the wire conveyor band and a roll of another conveyor band. Alternatively, this transfer means using a pneumatic suction may be replaced with transfer means using a pneumatic pressure.

Since the nonwoven fabric is not held and pressed between the rolls of the wire conveyor band and another conveyor band, the bulkiness or the softness of the formed nonwoven fabric is prevented from deteriorating.

DETAILED DESCRIPTION OF THE INVENTION

The present invention is now described with reference to the accompanying drawings.

Figure 1:
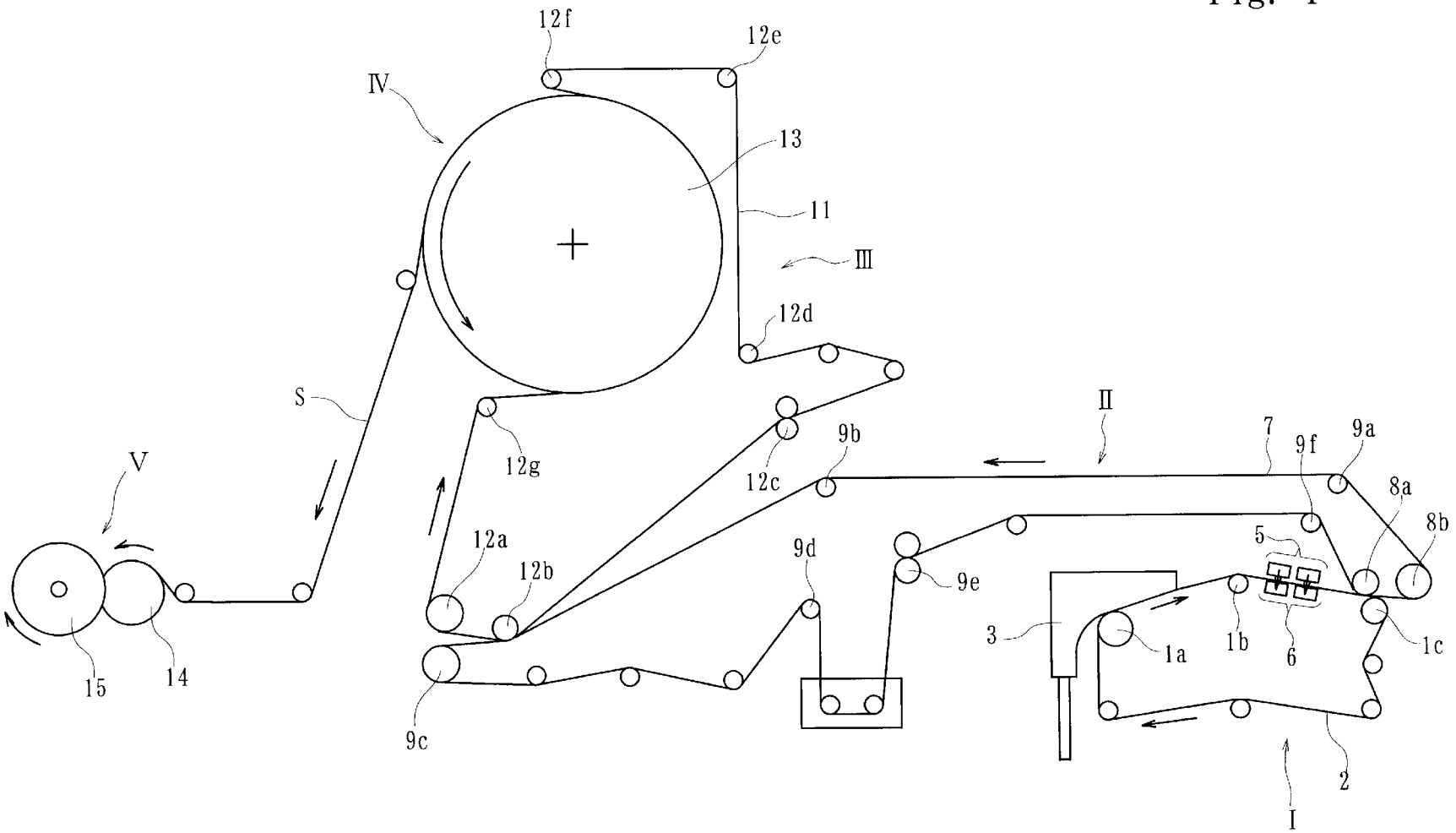
FIG. 1 is a construction diagram showing the entire facilities of an apparatus for manufacturing a nonwoven fabric according to a first embodiment of the invention.
Figure 2:
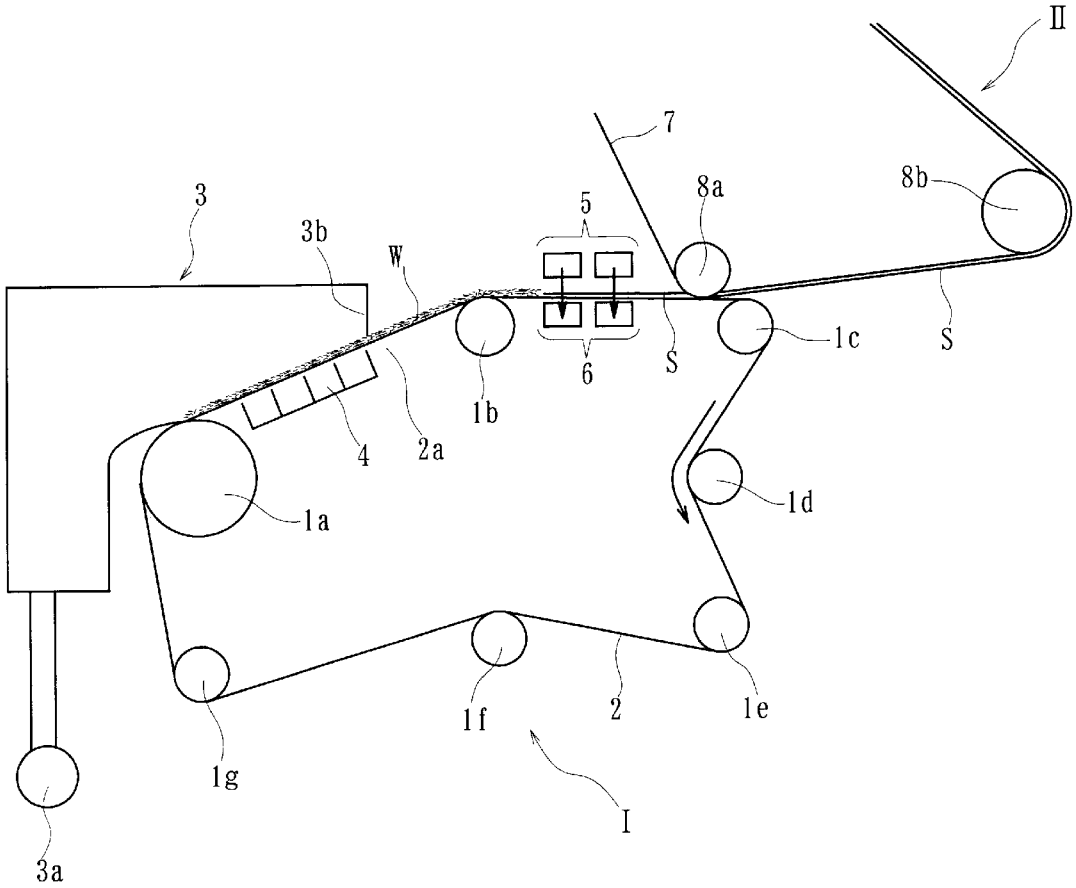
FIG. 2 is an enlarged diagram of a portion of the manufacturing apparatus shown in FIG. 1.

FIG. 1 is a structure diagram of the entire facilities used in a wet process for manufacturing a nonwoven fabric and a wet apparatus therefor according to a first embodiment of the invention. FIG. 2 is an enlarged diagram showing a nonwoven fabric forming portion of the apparatus of FIG. 1 in an enlarged scale.

The wet nonwoven fabric manufacturing apparatus shown in FIG. 1 includes a nonwoven fabric forming portion I, a felt conveying portion II, a transfer portion III, a drying portion IV and a take-up portion V.

The nonwoven fabric forming portion (or wet forming portion) I is provided, as shown in an enlarged scale in FIG. 2, with a wire conveyor band 2 which runs on a plurality of rolls 1*a* to 1*g*. The wire conveyor band 2 runs clockwise at a constant speed when a rotational drive force is applied to any of the rolls.

A slope portion 2*a*, as sloped uphill between the roll 1*a* and the roll 1*b*, of the wire conveyor band 2 is confronted thereabove by a raw material supply portion 3 and therebelow by a dehydrating bath 4. The raw material supply portion 3 is supplied with raw material fibers and water from a supply port 3*a*. These raw material fibers are exemplified by natural fibers such as rayon and/or polyester (PET) or polypropylene (PP), or composite fibers of PET and PP.

By the pneumatic suction force of the dehydrating bath 4, the fibers in the raw material supply portion 3 are attracted onto the wire conveyor band 2. The raw material supply portion 3 is provided with a filling member 3*b* called the "heel slice", which confronts the wire conveyor band 2 through a clearance, so that a fibrous web W of a predetermined thickness is formed over the wire conveyor band 2 through the clearance between the wire conveyor band 2 and the filling member 3*b*.

Between the rolls 1*b* and 1*c*, the wire conveyor band 2 is confronted thereabove by one or more stages of water jet nozzles 5 and therebelow by a dehydrating bath 6. Water jets are applied by the water jet nozzles 5 to the fibrous web W which is formed over the wire conveyor band 2 through the filling member 3*b*. By these water jets, the fibers in the fibrous web W are interlaced, partially interlaced or entangled in an interlaced manner to form a nonwoven fabric S. In this embodiment, as soon as the fibrous web W is formed over the wire conveyor band 2, the water jets are applied to complete the formation of the spun lace nonwoven fabric S over the wire conveyor band 2.

The wire conveyor band 2 is contacted by a felt conveyor band 7 of the felt conveying portion (or felt part) II. The felt conveyor band 7 is a blanket woven with a needle, so that the spun lace nonwoven fabric S formed over the wire conveyor band 2 is transferred to the felt conveyor band 7 due to the difference in roughness between the wire conveyor band 2 and the felt conveyor band 7.

In the felt conveying portion II, the felt conveyor band 7 is made to run on the rolls 8*a* and 8*b* in the vicinity of the wire conveyor band 2. The roll 8*a* and the roll 1*c* on the side of the wire conveyor band 2 are so staggered such that no pressure is applied to the nonwoven fabric S between the two rolls 8*a* and 1*c* thereby to prevent the bulkiness and softness of the nonwoven fabric S formed from deteriorating.

Further, the roll 8*a* can be a transfer means or suction pickup roll utilizing the pneumatic suction so that the nonwoven fabric S is easily transferred from the wire conveyor band 2 to the felt conveyor band 7. The suction pickup roll is a net-shaped roll, the inside of which is pneumatically sucked. When the suction pickup roll is thus used, the nonwoven fabric S, which is completely formed on the surface of the wire conveyor band 2, is transferred without fail to the felt conveyor band 7, even if the joint between the wire conveyor band 2 and the felt conveyor band 7 is not pushed by the rollers.

In the felt conveying portion II, the felt conveyor band 7 runs on the rolls 8*a* and 8*b* and rolls 9*a* to 9*f* so that it is driven counter-clockwise by a turning force applied to any roll.

The transfer portion III is provided with a second felt conveyor band 11. This felt conveyor band 11 is a blanket woven with a needle like the felt conveyor band 7 and is made to run on a plurality of rolls 12*a* to 12*g*. Between the rolls 12*f* and 12*g*, a drying drum 13 is embraced by the felt conveyor band 11. The felt conveyor band 11 and the drying drum 13 are contacted exclusively by the tension of the felt conveyor band 11, and any pressure structure of a roll and a drum is not present in between.

Although the felt conveyor band 7 and the second felt conveyor band 11 are contacted at a portion on the lefthand side of FIG. 1, a pressure portion (or press portion) between the rolls even at the contacted portions is not present. On the other hand, the felt conveyor band 7 and the felt conveyor band 11 are contacted mainly at a portion of the roll 12*b*, which is a suction pickup roll that functions as a pneumatically sucked transfer means.

The second felt conveyor band 11 is driven to run clockwise either by the turning force of any of the rolls 12*a* to 12*g* or by the turning force of the drying drum 13. The nonwoven fabric S, as conveyed adhering to the surface of the felt conveyor band 7, is transferred by the attraction of the roll 12*b* to the second felt conveyor band 11. Moreover, the nonwoven fabric S is wound and dried by the drying drum 13 of the drying portion IV. The dried nonwoven fabric S is taken up by a take-up roll 14 to complete the manufacture of a raw fabric 15 of the nonwoven fabric.

In the nonwoven fabric manufacturing apparatus, as shown in FIGS. 1 and 2, and in the manufacturing process using the manufacturing apparatus, the wet formation of the fibrous web and the formation of the nonwoven fabric by the water jets are completed on the wire conveyor band 2 in the nonwoven fabric forming portion (or wet forming portion) I. This makes it unnecessary to arrange another water jet treating portion at a downstream stage of the wet forming portion. Thus, the facility line can be shortened.

The nonwoven fabric S having been completely formed is transferred to the felt conveyor band 7 and the second felt conveyor band 11 and is conveyed to the drying portion IV and the take-up portion V. The nonwoven fabric S is transferred by the suction force of the suction pickup roll 8*a* between the wire conveyor band 2 and the felt conveyor band 7 and by the suction force of the suction pickup roll 12*b* between the felt conveyor band 7 and the felt conveyor band 11. The nonwoven fabric S is transferred exclusively by the tension of the felt conveyor band 11 between the felt conveyor band 11 and the drying drum 13. As a result, the nonwoven fabric S is not pressed, but taken up on the raw fabric 15 while retaining the bulkiness and the softness.

Figure 3:
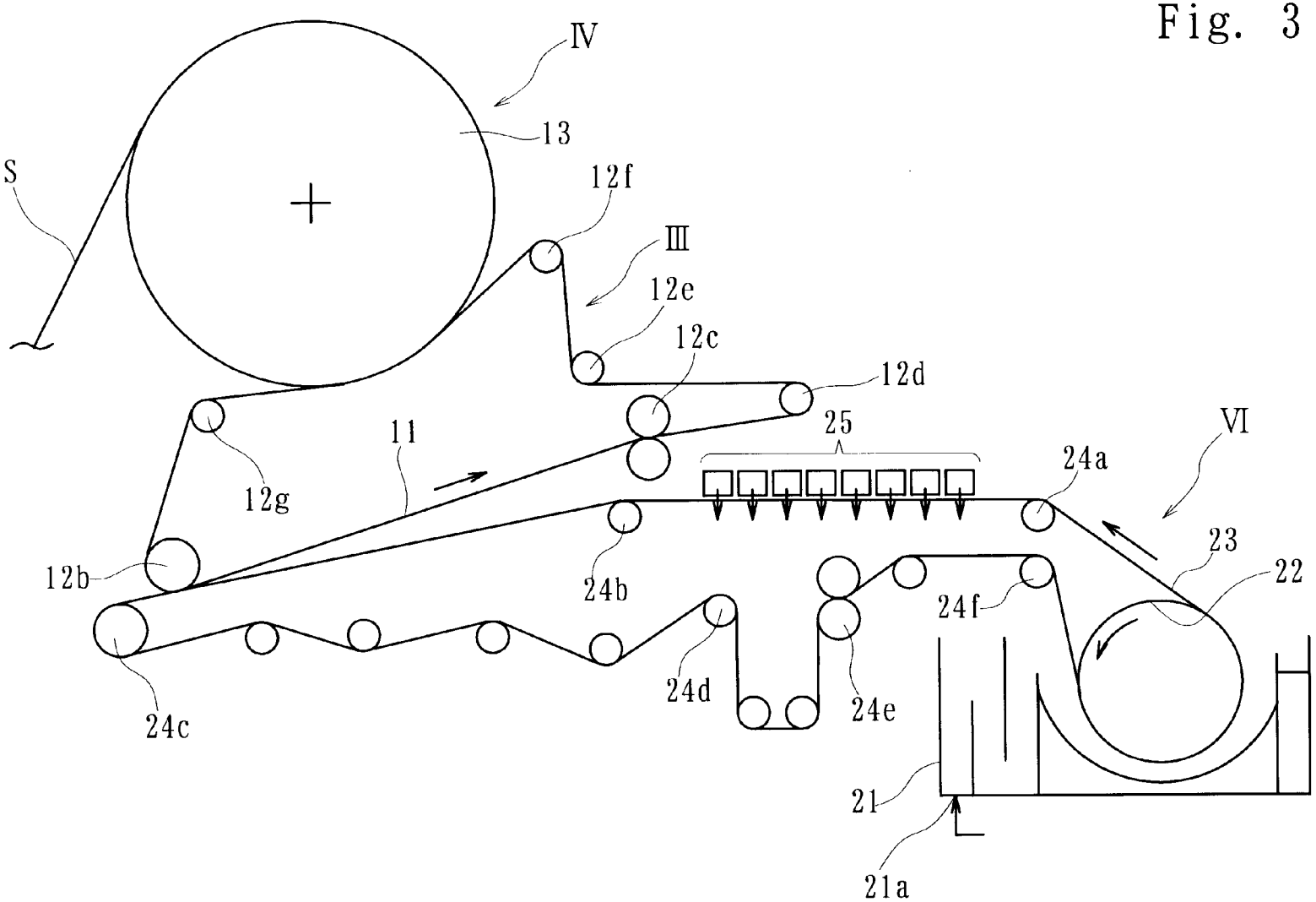
FIG. 3 is a construction diagram showing the entire facilities of an apparatus for manufacturing a nonwoven fabric according to a second embodiment of the invention.
Figure 5:
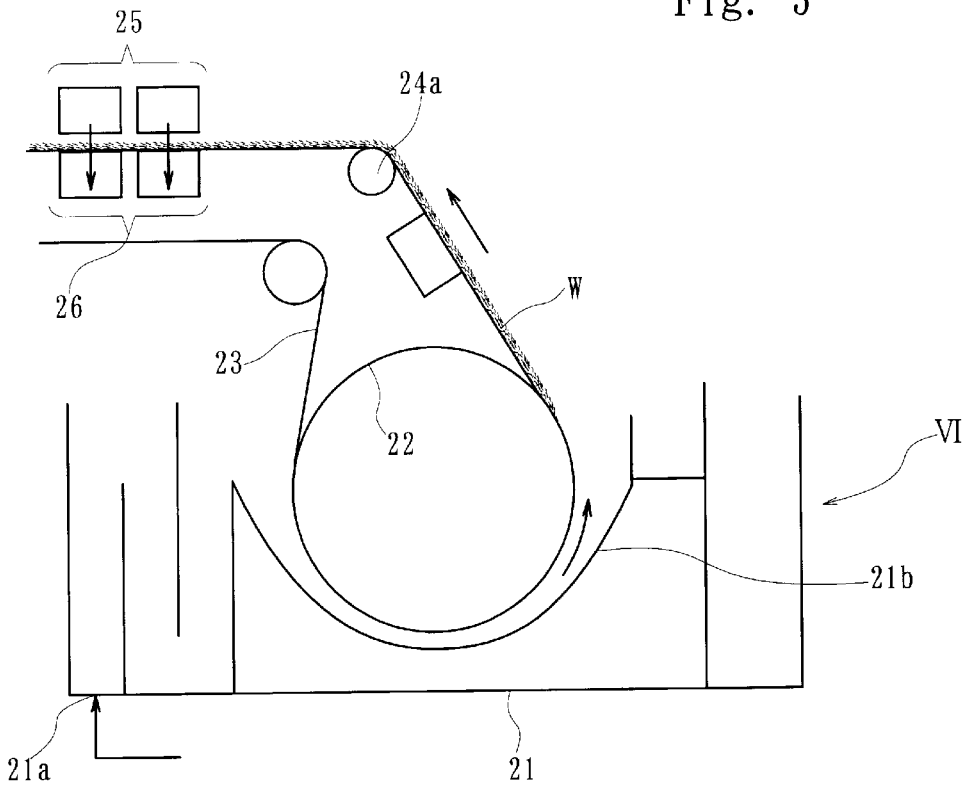
FIG. 5 is an enlarged diagram of a portion of the manufacturing apparatus shown in FIG. 3.

FIG. 3 is a structural diagram of the entire facilities for a wet process for manufacturing a nonwoven fabric and a wet apparatus therefor according to a second embodiment of the invention. FIG. 5 is a partially enlarged diagram showing a nonwoven fabric forming portion VI of the facilities shown in FIG. 3.

The nonwoven fabric forming portion VI is provided with a raw material bath (or raw material supply portion) 21, in which a cylinder mold 22 or rotary member made of a cylindrical net and permeable to a liquid is rotationally driven counter-clockwise.

A wire conveyor band 23 runs on the cylinder mold 22. This wire conveyor band 23 runs not only on the cylinder mold 22 but also on other rolls 24 to 24*f* counter-clockwise together with the cylinder mold 22.

The wire conveyor band 23 moves between the roll 24*a* and the roll 24*b* and is confronted thereabove by one or more stages of water jet nozzles 25 and therebelow by a dehydrating bath 26.

As shown in FIG. 5, the raw material fibers and water, as supplied from a supply port 21*a* into the raw material bath 21, are carried forward and backward over a cylindrical bath bottom face 21*b* onto the surface of the wire conveyor band 23 so that the raw material fibers are scooped over on the surface of the wire conveyor band 23 to form the fibrous web W. Here, the water scooped up together with the raw material fibers flows down into the raw material bath 21 through the wire conveyor band 23 and the cylinder mold 22 so that the fibrous web W is dehydrated.

The water jets are instantly applied from the water jet nozzles 25 to the fibrous web W, as conveyed on the wire conveyor band 23, so that the fibers of the fibrous web W are interlaced or partially interlaced to complete the formation of the spun lace nonwoven fabric S over the wire conveyor band 23.

To the nonwoven fabric forming portion VI, there are continued the transfer portion III, the drying portion IV and the take-up portion V. These are substantially identical to those shown in FIG. 1 and are designated by the common reference numerals. The take-up portion V is not shown in FIG. 3.

The wire conveyor band 23 is contacted with the felt conveyor band 11 at the downstream stage, but no pressure structure between rolls is present at that contact portion. At the portion where the felt conveyor band 11 and the wire conveyor band 23 are contacted, the roll 12*b* is disposed on the inner side of the felt conveyor band 11. This roll 12*b* is a suction pickup roll.

The felt conveyor band 11 runs on the rolls 12*b* to 12*g*. The felt conveyor band 11 and the drying drum 13 are so contacted between the rolls 12*f* and 12*g* that the felt conveyor band 11 embraces the drying drum 13. The felt conveyor band 11 is contacted with the drying drum 13 exclusively by its own tension.

The nonwoven fabric S, as formed over the wire conveyor band 23 by the application of the water jets, is transferred to the felt conveyor band 11 due to the difference in roughness between the wire conveyor band 23 and the felt conveyor band 11 and by the pneumatic suction force of the roll 12*b*. Moreover, the nonwoven fabric S is transferred between the rolls 12*f* and 12*g* to the drying drum 13. The nonwoven fabric S, as dried by the drying drum 13, is taken up by the take-up roll 14, as shown in FIG. 1, to form the raw fabric 15.

In the embodiment shown in FIG. 3, too, the nonwoven fabric S, to which the water jets were applied, is not pressed between the rolls but dried and taken up. As a result, the bulkiness and soft feeling of the nonwoven fabric S are not deteriorated.

The manufacturing apparatus shown in FIG. 3 can be constructed by improving a uni-flow (or counter-flow) type cylinder Yankee machine of the prior art. In the conventional uni-flow type cylinder Yankee machine, a paper material in the raw material bath is scooped up by the cylinder mold to make the paper over the surface of the cylinder mold, which is contacted with a felt conveyor band. By making use of the difference in the surface roughness between the cylinder mold and the felt conveyor band, the paper made over the cylinder mold is transferred to the felt conveyor band. The manufacturing apparatus shown in FIG. 3 is constructed by tensing the wire conveyor band 23 in place of the felt conveyor band of the felt part of the conventional uni-flow type cylinder Yankee machine, and by making the wire conveyor band 23 run on the cylinder mold 22. This enables the fibers, as scooped up from the raw material bath 21 by the wire conveyor band 23, to be instantly treated with the water jets by the wire conveyor band 23. Thus, the wet spun lace nonwoven fabric manufacturing apparatus can be constructed by slightly improving the conventional uni-flow type cylinder Yankee machine.

Since the wire conveyor band 23, as tensed in place of the felt conveyor band of the conventional uni-flow type cylinder Yankee machine, is confronted by the water jet nozzles 25, the line for manufacturing the wet spun lace nonwoven fabric can be remarkably shortened. The manufacturing rate of the nonwoven fabric can be accelerated to achieve a manufacturing rate of about 600 m per minute.

Figure 4:
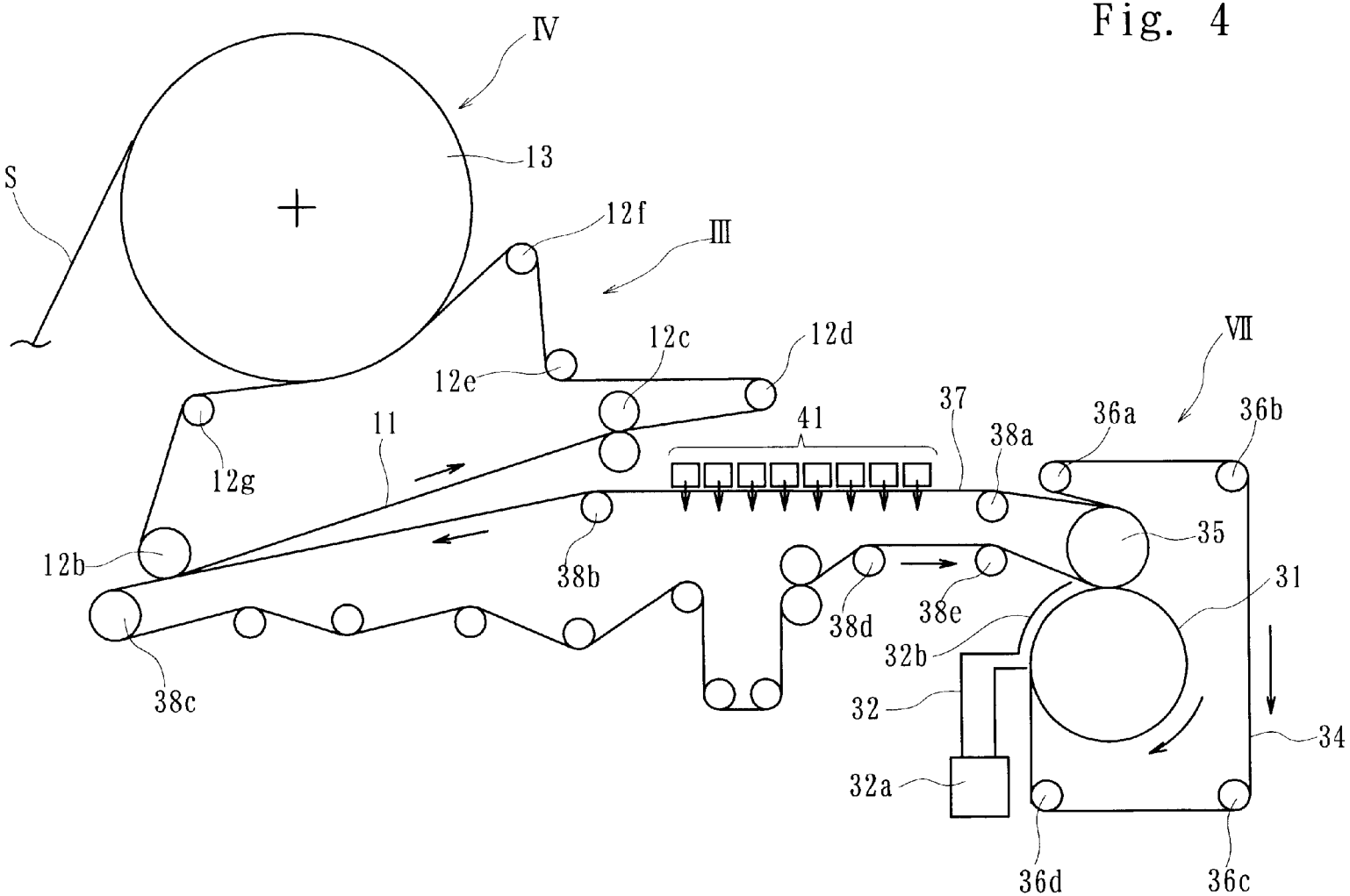
FIG. 4 is a construction diagram showing the entire facilities of an apparatus for manufacturing a nonwoven fabric according to a third embodiment of the invention.
Figure 6:
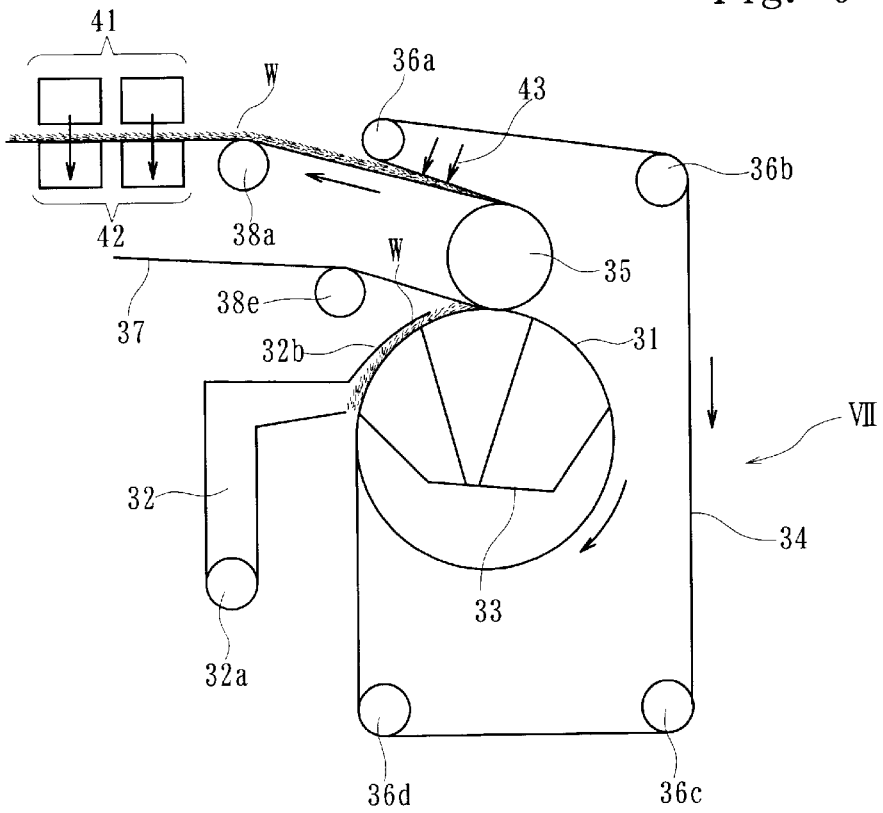
FIG. 6 is an enlarged diagram of a portion of the manufacturing apparatus shown in FIG. 4.

FIG. 4 is a structural diagram of the entire facilities for a wet process of manufacturing a nonwoven fabric and a wet apparatus therefor according to a third embodiment of the invention. FIG. 6 is a partially enlarged diagram showing a nonwoven fabric forming portion VII of the manufacturing facilities of FIG. 4.

The nonwoven fabric forming portion VII of this embodiment is provided with a cylinder mold 31 or rotary member which is made of a cylindrical net, permeable to a liquid, and is rotationally driven clockwise. At an obliquely lefthand upper portion of the cylinder mold 31, there is disposed a raw material fiber supply portion 32, to which raw material fibers are supplied together with water from a supply port 32*a*. In the cylinder mold 31, as shown in FIG. 6, there is disposed a dehydrating bath 33 which confronts the supply portion 32, so that the raw material fibers and water supplied from the supply portion 32 are sucked by the dehydrating bath 33.

A first wire conveyor band 34, which is formed of a net of plastics of a predetermined mesh called the "plastic wire", is run on the cylinder mold 31. This first wire conveyor band 34 is run clockwise on the cylinder mold 31, roll 35 and rolls 36*a* to 36*d*, as the cylinder mold 31 rotates.

A second wire conveyor band 37, which is also called the "plastic wire", is run on the roll 35. As shown in FIG. 4, the second wire conveyor band 37 is run on the outer circumference of the roll 35 and is embraced on its outer side by the first wire conveyor band 34. As shown in FIG. 4, the second wire conveyor band 37 is run counter-clockwise on roll 35 and other rolls 38*a* to 38*e*. This second wire conveyor band 37 is run on a path substantially identical to that of the wire conveyor band 23 of the embodiment shown in FIG. 3.

Between the roll 38*a* and the roll 38*b*, the second wire conveyor band 37 is confronted thereabove by one or more stages of water jet nozzles 41 and therebelow by a dehydrating bath 42.

As shown in FIG. 4, the second wire conveyor band 37 is contacted at a downstream stage by the felt conveyor band 11, which in turn is contacted at a downstream stage by the drying drum 13. In the apparatus shown in FIG. 4, the transfer portion III, the drying portion IV and the take-up portion V at the downstream stage of the second wire conveyor band 37 have constructions identical to those of the embodiment shown in FIG. 3, and are designated by the common reference numerals.

In the manufacturing process using the apparatus shown in FIGS. 4 and 6, the cylinder mold 31 rotates clockwise so that the first wire conveyor band 34 rotates clockwise. The raw material fibers and water are supplied obliquely downward from the raw material supply portion 32 to the first wire conveyor band 34 running on the surface of the cylinder mold 31. At this time, the water is sucked by the dehydrating bath 33 so that the fibrous web W is formed in the clearance between a forming portion 32*b* of the supply portion 32 and the first wire conveyor band 34.

The formed fibrous web W is transferred at the outer circumference of the roll 35 from the first wire conveyor band 34 to the second wire conveyor band 37. Here at this transfer portion, the two wire conveyor bands 34 and 37 are not pressed by the pressure of the rolls so that the fibrous web W to be transferred from the wire conveyor band 34 to the wire conveyor band 37 is not pressed more than necessary. A transfer means is provided for blowing an air flow 43 (as shown in FIG. 6) from the first wire conveyor band 34 to the second wire conveyor band 37 immediately after the wire conveyor bands 34 and 37 leave the roll 35, so that the fibrous web W over the surface of the first wire conveyor band 34 is made liable to be forcibly transferred to the second wire conveyor band 37.

In order to facilitate the transfer of the fibrous web W from the first wire conveyor band 34 to the second wire conveyor band 37, it is preferable to make the second wire conveyor band 37 denser than the first wire conveyor band 34 such that the first wire conveyor band 34 has 80 meshes whereas the second wire conveyor band 37 has 90 meshes.

The spun lace nonwoven fabric S is formed by applying the water jets from the water jet nozzles 41 to the fibrous web W transferred and conveyed on the second wire conveyor band 37, to interlace or partially interlace the fibers of the fibrous web W.

The nonwoven fabric S, as completely formed over the second wire conveyor band 37, is sucked by the roll 12*b* (i.e., suction pickup roll 12*b*) and transferred to the felt conveyor band 11. It is then transferred to and dried by the drying drum 13 until it is taken up by the take-up roll 14 (identical to that shown in FIG. 1). In this embodiment, too, no pressure portion of the rolls is present in the conveyor paths of the fibrous web W and the nonwoven fabric S, so that the bulkiness and softness of the nonwoven fabric is not deteriorated.

The wet nonwoven fabric manufacturing apparatus, as shown in FIGS. 4 and 6, can be constructed by making use of a former type cylinder Yankee machine of the prior art.

In the conventional former type cylinder Yankee machine, a paper material and water are poured from the raw material supply portion to the surface of the cylinder mold so that paper is made over the surface of the cylinder mold. The paper is transferred from the surface of the cylinder mold to a felt conveyor band in a felt part by making use of the difference in the surface roughness and is then dried by the drying drum. The wet nonwoven fabric manufacturing apparatus of the invention is constructed by tensing the second wire conveyor band 37 in place of the felt conveyor band in that felt part of the conventional former type cylinder Yankee machine and by making the water jet nozzles 41 confront the wire conveyor band 37.

Since the wire conveyor band 37 is tensed in place of the felt conveyor band, however, it is difficult to transfer the fibrous web W directly from the cylinder mold 31 to the wire conveyor band 37, unlike the conventional former type cylinder Yankee machine which transfers the paper from the cylinder mold 31 to the felt conveyor band by making use of the difference in the surface roughness. In this wet nonwoven fabric manufacturing apparatus, therefore, the wire conveyor band 34 is further provided to run on the cylinder mold 31 and to embrace the second wire conveyor band 37, so that the fibrous web W formed over the wire conveyor band 34 can be transferred to the second wire conveyor band 37. Thus, the wet nonwoven fabric manufacturing apparatus can be constructed by slightly improving the conventional former type cylinder Yankee machine.

Figure 7:
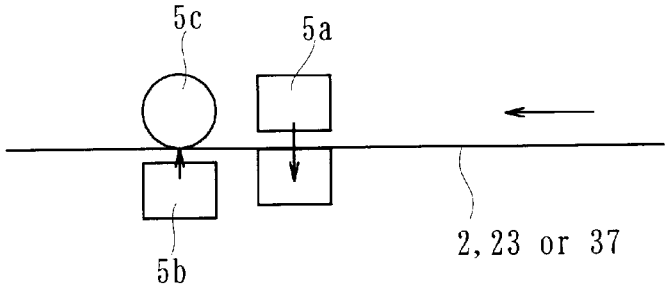
FIG. 7 is a partially enlarged diagram showing an example of an array of a water jet nozzle.

Here, in the foregoing individual embodiments, the wire conveyor band 2, 23 or 37 is confronted on its surface side by the water jet nozzles 5, 25 and 41. As shown in FIG. 7, however, on the upstream side of the wire conveyor band 2, 23 or 37, the surface side of the fibrous web W may be confronted by a water jet nozzle 5*a* so that the water jet is applied from the surface side to the fibrous web W. On the downstream side, the back side of the fibrous web W may be confronted by a water jet nozzle 5*b*, which may be confronted by a roll 5*c*, so that the water jets may be applied to both the surface and back sides of the fibrous web W.

Figure 8:
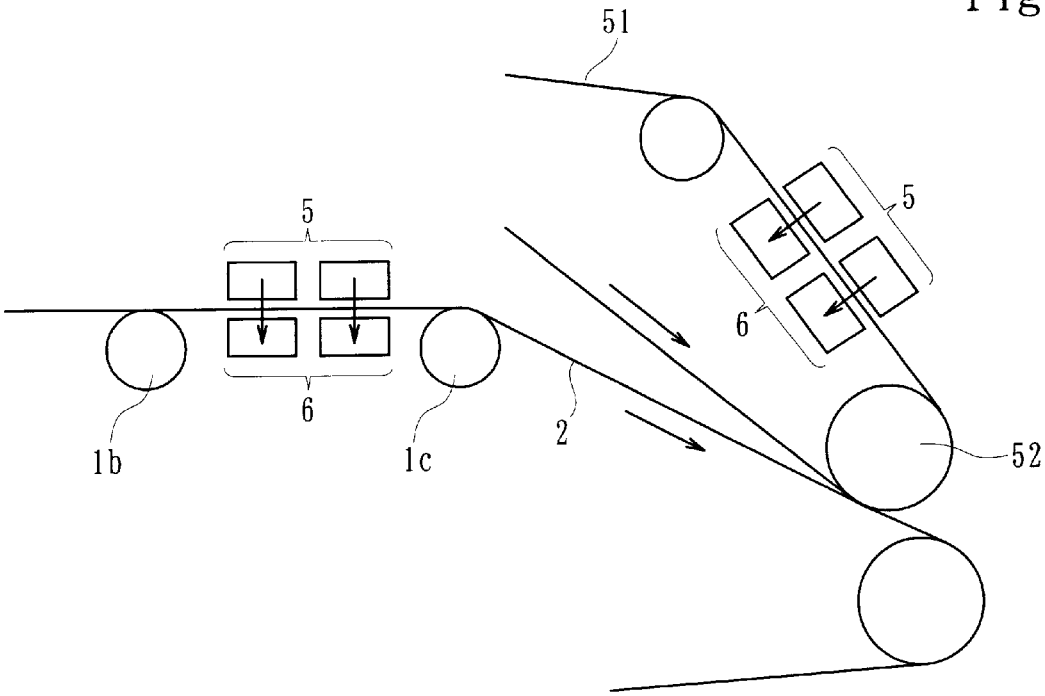
FIG. 8 is a partially enlarged diagram showing an example of an array of the water jet nozzle.

As shown in FIG. 8, the apparatus shown in FIGS. 1 and 2, for example, can be constructed in the following manner. After the water jet is applied to the surface side of the fibrous web W conveyed by the wire conveyor band 2, the fibrous web W over the wire conveyor band 2 is transferred to a wire conveyor band 51 in place of the felt conveyor band 7 at a next stage by a suction pickup roll 52. The water jet is applied from the side opposite to the aforementioned side to the fibrous web conveyed by the wire conveyor band 51.

In the nonwoven fabric manufacturing process and apparatus of the invention, as described hereinbefore, the distance between the fibrous web forming step and the fiber interlacing step can be shortened when the spun lace nonwoven fabric is manufactured by the wet method, thereby constructing the manufacturing line in a smaller space.

The fibrous web forming step can also be practiced by improving the wet paper making apparatus of the prior art.

While in the foregoing specification the present invention has been described in relation to preferred embodiments and many details have been set forth for purpose of illustration, it will be apparent to those skilled in the art that the present invention is susceptible to additional embodiments and that certain of the details described herein can be varied considerably without departing from the basic principles of the present invention.

What is claimed is:

1. A wet process for manufacturing a nonwoven fabric, comprising the steps of:

forming a fibrous web by supplying raw material fibers together with water onto a slope of a net-shaped wire conveyor band running on a plurality of rolls;

completely forming a nonwoven fabric over the wire conveyor band by supplying water jets to the fibrous web over the wire conveyor band;

transferring the formed nonwoven fabric from the wire conveyor band to another conveyor band; and drying the nonwoven fabric.

2. The wet nonwoven fabric manufacturing process according to claim 1, wherein the nonwoven fabric completely formed over the wire conveyor band is forcibly transferred to another conveyor band by using a pneumatic suction.

3. The wet nonwoven fabric manufacturing process according to claim 2, wherein the water jets are applied to both the surface and back sides of the fibrous web over the wire conveyor band.

4. A wet process for manufacturing a nonwoven fabric, comprising the steps of:

forming a fibrous web by supplying raw material fibers together with water onto a net-shaped wire conveyor band running on a cylinder mold to scoop the raw material fibers with the wire conveyor band;

completely forming a nonwoven fabric over the wire conveyor band by supplying water jets to the fibrous web over the wire conveyor band;

transferring the formed nonwoven fabric from the wire conveyor band to another conveyor band; and drying the nonwoven fabric.

5. The wet nonwoven fabric manufacturing process according to claim 4, wherein the nonwoven fabric completely formed over the wire conveyor band is forcibly transferred to another conveyor band by using a pneumatic suction.

6. The wet nonwoven fabric manufacturing process according to claim 5, wherein the water jets are applied to both the surface and back sides of the fibrous web over the wire conveyor band.

7. A wet process for manufacturing a nonwoven fabric, comprising the steps of:

forming a fibrous web by supplying raw material fibers together with water onto a net-shaped wire conveyor band running on a cylinder mold to scoop the raw material fibers with the wire conveyor band;

transferring the fibrous web over the wire conveyor band to a wire conveyor band at a next stage;

completely forming a nonwoven fabric over the wire conveyor band at the next stage by supplying water jets to the fibrous web over the wire conveyor band;

transferring the formed nonwoven fabric from the wire conveyor band to another conveyor band; and drying the nonwoven fabric.

8. The wet nonwoven fabric manufacturing process according to claim 7, wherein the fibrous web over the wire conveyor band running on the cylinder mold is forcibly transferred to the wire conveyor band at the next stage by using a pneumatic pressure.

9. The wet nonwoven fabric manufacturing process according to claim 8, wherein the nonwoven fabric completely formed over the wire conveyor band is forcibly transferred to another conveyor band by using a pneumatic suction.

10. The wet nonwoven fabric manufacturing process according to claim 9, wherein the water jets are applied to both the surface and back sides of the fibrous web over the wire conveyor band.

11. A wet apparatus for manufacturing a nonwoven fabric, comprising:

a net-shaped wire conveyor band for running on a plurality of rolls;

a raw material supply portion for supplying raw material fibers together with water onto a slope of the wire conveyor band;

water jet nozzles confronting the wire conveyor band for forming a nonwoven fabric completely over the wire conveyor band by applying water jets to a fibrous web formed over the wire conveyor band;

another conveyor band to which the nonwoven fabric completely formed over the wire conveyor band is transferred; and a drying portion at a downstream stage for drying the nonwoven fabric.

12. The wet nonwoven fabric manufacturing apparatus according to claim 11, wherein the nonwoven fabric formed over the wire conveyor band is transferred to another conveyor band by a transfer means using a pneumatic suction, without holding and pressing the nonwoven fabric between a roll of the wire conveyor band and a roll of another conveyor band.

13. The wet apparatus for manufacturing a nonwoven fabric, comprising:

a raw material bath to which raw material fibers are supplied together with water;

a cylinder mold disposed in the raw material bath;

a net-shaped wire conveyor band made to run on the cylinder mold;

water jet nozzles confronting the wire conveyor band for forming a nonwoven fabric completely by applying water jets to a fibrous web scooped over the wire conveyor band from the inside of the raw material bath;

another conveyor band to which the nonwoven fabric completely formed over the wire conveyor band is transferred; and a drying portion at a downstream stage for drying the nonwoven fabric.

14. The wet nonwoven fabric manufacturing apparatus according to claim 13, wherein the nonwoven fabric formed over the wire conveyor band is transferred to another conveyor band by transfer means using a pneumatic suction, without holding and pressing the nonwoven fabric between a roll of the wire conveyor band and a roll of another conveyor band.

15. A wet apparatus for manufacturing a nonwoven fabric, comprising:

a cylinder mold;

a net-shaped wire conveyor band made to run on the cylinder mold;

a former for forming a fibrous web over the wire conveyor band by applying raw material fibers and water to the wire conveyor band;

a next stage wire conveyor band to which the fibrous web formed over the wire conveyor band is transferred;

water jet nozzles confronting the next stage wire conveyor band for forming a nonwoven fabric completely by applying water jets to the fibrous web over the next stage wire conveyor band;

another conveyor band to which the nonwoven fabric completely formed over the wire conveyor band is transferred; and a drying portion at a downstream stage for drying the nonwoven fabric.

16. The wet nonwoven fabric manufacturing apparatus according to claim 15, further comprising:

a transfer means for transferring the fibrous web forcibly from the wire conveyor band running on the cylinder mold to the next stage wire conveyor band by using a pneumatic pressure.

17. The wet nonwoven fabric manufacturing apparatus according to claim 16, wherein the nonwoven fabric formed over the wire conveyor band is transferred to another conveyor band by transfer means using a pneumatic suction, without holding and pressing the nonwoven fabric between a roll of the wire conveyor band and a roll of another conveyor band.

* * * * *